US010549543B2

(12) United States Patent
Kubodera et al.

(10) Patent No.: US 10,549,543 B2
(45) Date of Patent: Feb. 4, 2020

(54) LIQUID DISCHARGE APPARATUS

(71) Applicants: Takaya Kubodera, Kanagawa (JP); Yuta Moriwaki, Kanagawa (JP)

(72) Inventors: Takaya Kubodera, Kanagawa (JP); Yuta Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/237,769

(22) Filed: Jan. 2, 2019

(65) Prior Publication Data

US 2019/0232676 A1 Aug. 1, 2019

(30) Foreign Application Priority Data

Jan. 26, 2018 (JP) ..... 2018-011428

(51) Int. Cl.
*B41J 2/175* (2006.01)
*B41J 2/17* (2006.01)
(Continued)

(52) U.S. Cl.
CPC ..... *B41J 2/185* (2013.01); *B41J 2/14* (2013.01); *B41J 2/14233* (2013.01);
(Continued)

(58) Field of Classification Search
CPC ... B41J 2/01; B41J 2/14; B41J 2/14233; B41J 2/16505; B41J 2/16547; B41J 2/1707; B41J 2/175; B41J 2/17506; B41J 2/17509; B41J 2/17523; B41J 2/17596; B41J 2/18; B41J 2/185; B41J 2/195; B41J 2202/12
See application file for complete search history.

(56) References Cited

U.S. PATENT DOCUMENTS 7,874,656 B2 * 1/2011 Ota ..... B41J 2/17556 347/85
8,328,335 B2 * 12/2012 Xie ..... B41J 2/14016 347/20

(Continued)

FOREIGN PATENT DOCUMENTS

| | | |
|---|---|---|
| JP | 2011-073362 | 4/2011 |
| JP | 2013-212630 | 10/2013 |
| JP | 2015-212047 | 11/2015 |

*Primary Examiner* — Anh T Vo
(74) *Attorney, Agent, or Firm* — Oblon, McClelland, Maier & Neustadt, L.L.P.

(57) ABSTRACT

A liquid discharge apparatus includes a liquid discharge head including a supply port, a recovery port, and nozzles to discharge a liquid from the nozzles, a circulation channel connected to the supply port and the recovery port of the liquid discharge head to circulate the liquid through the liquid discharge head, and a cap to cap a nozzle surface of the liquid discharge head in which the nozzles are formed and to suck the liquid from the nozzles in a maintenance operation. The circulation channel includes an individual supply channel communicating with the supply port of the liquid discharge head, an individual recovery channel communicating with the recovery port of the liquid discharge head to circulate the liquid through the liquid discharge head, a supply-side fluid resistance variable section disposed in the individual supply channel to vary fluid a resistance of the individual supply channel.

8 Claims, 13 Drawing Sheets

(51) Int. Cl.

| | |
|---|---|
| ***B41J 2/18*** | (2006.01) |
| ***B41J 2/185*** | (2006.01) |
| ***B41J 2/195*** | (2006.01) |
| ***B41J 2/14*** | (2006.01) |

(52) U.S. Cl.
CPC ..... *B41J 2/1707* (2013.01); *B41J 2/18* (2013.01); *B41J 2/195* (2013.01); *B41J 2202/12* (2013.01)

(56) References Cited

U.S. PATENT DOCUMENTS

| | | | | |
|---|---|---|---|---|
| 8,562,119 | B2 * | 10/2013 | Xie | B41J 2/1404 347/54 |
| 2002/0196316 | A1 * | 12/2002 | Nakamura | B41J 2/175 347/84 |
| 2010/0214334 | A1 * | 8/2010 | Kusunoki | B41J 2/04581 347/9 |
| 2011/0069118 | A1 * | 3/2011 | Ohzeki | B41J 2/14233 347/44 |
| 2011/0148988 | A1 * | 6/2011 | Hoisington | B41J 2/14233 347/54 |
| 2015/0062255 | A1 | 3/2015 | Sasaki | |
| 2016/0129693 | A1 | 5/2016 | Moriwaki et al. | |
| 2016/0185113 | A1 | 6/2016 | Yoshida et al. | |
| 2017/0120602 | A1 | 5/2017 | Nakai et al. | |
| 2017/0297333 | A1 | 10/2017 | Kohda et al. | |
| 2018/0072066 | A1 | 3/2018 | Yoneta | |
| 2018/0272739 | A1 | 9/2018 | Sawase et al. | |

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-011428, filed on Jan. 26, 2018, in the Japan Patent Office, the entire disclosure of which is incorporated by reference herein.

BACKGROUND

Technical Field

The present disclosure relates to a liquid discharge apparatus.

Description of the Related Art

As a liquid discharge head (hereinafter simply referred to as a "head"), there is a flow-through type head (circulation type head) having a supply channel to an individual chamber communicating with a nozzle and a recovery channel communicating with the individual chamber, a liquid supply port communicating with the supply channel, and a liquid recovery port communicating with the recovery channel.

Then, an image forming apparatus is known, which includes a first path through which ink supplied to the ink-jet head passes, a second path through which the ink discharged from the ink-jet head passes, a circulation device for circulating the ink between an ink tank and the ink-jet head via the first path and the second path, an inner diameter changing section for changing an inner diameter of at least a part of the first path or the second path, and a control section for changing the inner diameter of the first path or the second path by the inner diameter changing section so that the channel resistance of the first path and the channel resistance of the second path become closer to each other based on the channel resistance of the first path and the channel resistance of the second path.

SUMMARY

In an aspect of this disclosure, a novel liquid discharge apparatus is provided in which the liquid discharge apparatus includes a liquid discharge head including a supply port, a recovery port, and nozzles to discharge a liquid from the nozzles, a circulation channel connected to the supply port and the recovery port of the liquid discharge head to circulate the liquid through the liquid discharge head, and a cap to cap a nozzle surface of the liquid discharge head in which the nozzles are formed and to suck the liquid from the nozzles in a maintenance operation. The circulation channel includes an individual supply channel communicating with the supply port of the liquid discharge head, an individual recovery channel communicating with the recovery port of the liquid discharge head to circulate the liquid through the liquid discharge head, a supply-side fluid resistance variable section disposed in the individual supply channel to vary a fluid resistance of the individual supply channel, a recovery-side fluid resistance variable section disposed in the individual recovery channel to vary a fluid resistance of the individual recovery channel, and circuitry to cause the supply-side fluid resistance variable section and the recovery-side fluid resistance variable section to change the fluid resistance of the individual supply channel and the fluid resistance of the individual recovery channel. The circuitry causes the supply-side fluid resistance variable section and the recovery-side fluid resistance variable section to increase one of the fluid resistance of the individual supply channel and the fluid resistance of the individual recovery channel to be higher than another of the fluid resistance of the individual supply channel and the fluid resistance of the individual recovery channel in the maintenance operation.

In an aspect of this disclosure, a novel liquid discharge apparatus includes a plurality of liquid discharge heads each including a supply port, a recovery port, and nozzles to discharge a liquid from the nozzles, a circulation channel connected to each of the supply port and the recovery port of the plurality of liquid discharge heads to circulate the liquid through the plurality of liquid discharge heads, and a cap to cap a nozzle surface of at least one of the plurality of liquid discharge heads in each which the nozzles are formed and to suck the liquid from the nozzles in a maintenance operation. The circulation channel includes a plurality of individual supply channels communicating with the supply ports of the plurality of liquid discharge heads, respectively, a plurality of individual recovery channels communicating with the recovery ports of the plurality of liquid discharge heads, respectively, to circulate the liquid through the plurality of liquid discharge heads, a plurality of supply-side fluid resistance variable sections disposed in the plurality of individual supply channels, respectively, to vary fluid resistances of the plurality of individual supply channels, a plurality of recovery-side fluid resistance variable sections disposed in the plurality of individual recovery channels, respectively, to vary fluid resistances of the plurality of individual recovery channels, and circuitry to cause the plurality of supply-side fluid resistance variable sections and the plurality of recovery-side fluid resistance variable sections to change the fluid resistances of the plurality of individual supply channels and the fluid resistances of the plurality of individual recovery channels. The circuitry causes the plurality of supply-side fluid resistance variable sections and the plurality of recovery-side fluid resistance variable sections to decrease a fluid resistance of each of one of the plurality of individual supply channels and one of the plurality of individual recovery channels, which are connected to one of the plurality of liquid discharge heads on which the maintenance operation is performed, to be lower than a fluid distance of each of another of the plurality of individual supply channels and another of the plurality of individual recovery channels, which are connected to another of the plurality of liquid discharge heads on which the maintenance operation is not performed, in the maintenance operation.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
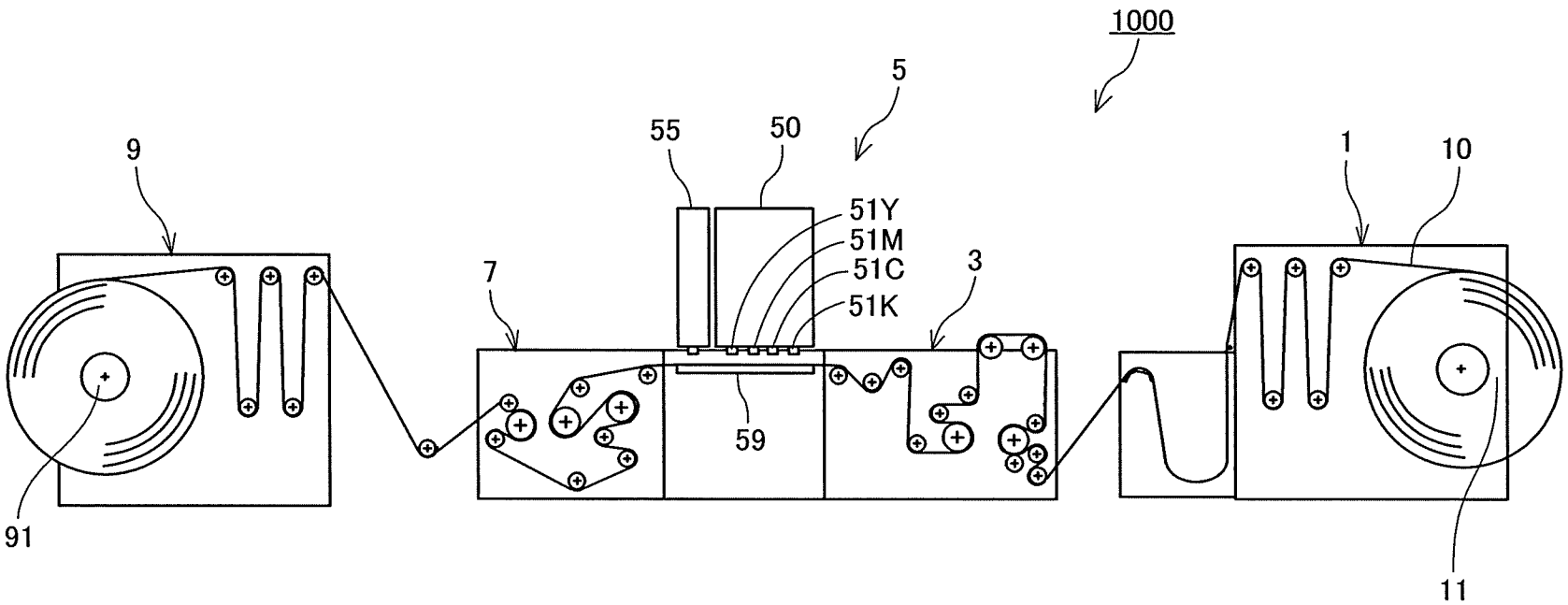
FIG. 1 is an explanatory schematic view of an example of a liquid discharge apparatus according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
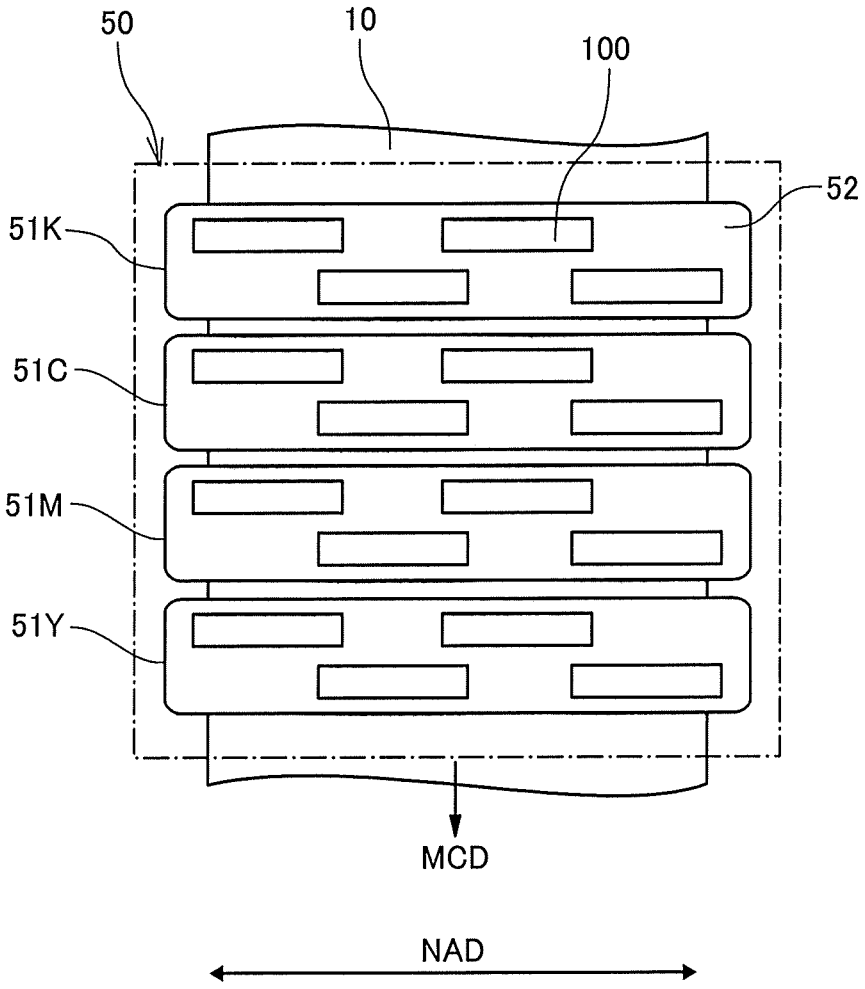
FIG. 2 is an explanatory plan view of an example of a head unit of the apparatus.

Hereinafter, embodiments of the present disclosure will be described referring to the accompanying drawings. First, a liquid discharge apparatus according to an embodiment of the present disclosure will be described referring to FIGS. 1 and 2. FIG. 1 is an explanatory schematic view of the liquid discharge apparatus, and FIG. 2 is an explanatory plan view of an example of a head unit of the liquid discharge apparatus.

A printing apparatus 1000 which is the liquid discharge apparatus according to the present embodiment includes a carrying-in unit 1 to carry in a continuous body 10, a guide conveyance unit 3 to guide and convey the continuous body 10 carried in from the carrying-in unit 1 to a printing unit 5, the printing unit 5 to print by discharging a liquid onto a continuous body 10 to form an image, a drying unit 7 to dry the continuous body 10, a carrying-out unit 9 to carry out the continuous body 10, and the like.

The continuous body 10 is fed out from an original winding roller 11 of the carrying-in unit 1 and guided and conveyed by rollers of the carrying-in unit 1, the guide conveyance unit 3, the drying unit 7, and the carrying-out unit 9, and then rolled up by a wind-up roller 91 of the carrying-out unit 9.

In the printing unit 5, the continuous body 10 is conveyed on a conveyance guide member 59 while facing a head unit 50 and a head unit 55, and an image is formed by the liquid discharged from the head unit 50, and post-treatment is performed with the treatment liquid discharged from the head unit 55.

Here, the head unit 50 is provided with full-line type head arrays 51K, 51C, 51M, and 51Y (hereinafter, referred to as "head array 51" unless colors are distinguished) for four colors are arranged in order from the upstream side in a medium conveyance direction indicated by arrow MCD in FIG. 2, for example.

The head arrays 51 are liquid discharging units, and respectively discharge liquids of black K, cyan C, magenta M, and yellow Y onto the continuous body 10 being conveyed. The type and number of colors are not limited to this.

The head array 51 is formed by arranging liquid discharge heads (also referred to simply as "heads") 100 in a zigzag on a base member 52 as illustrated in FIG. 2 for example, but the structure is not limited to this.

Figure 3:
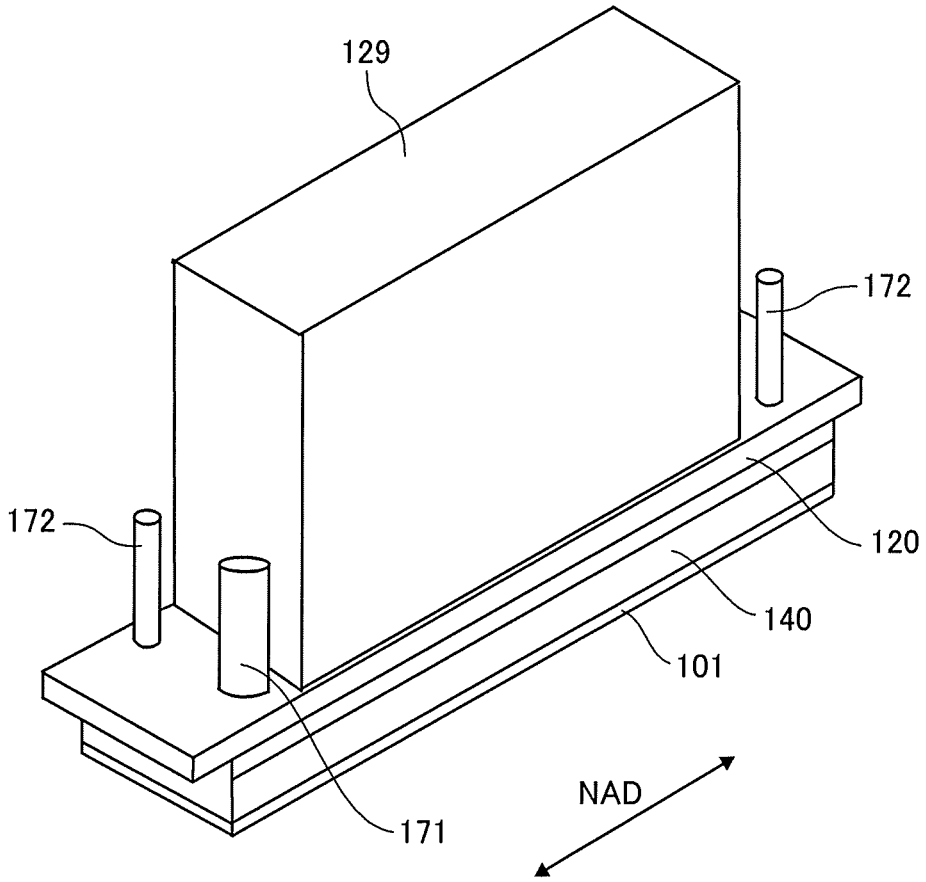
FIG. 3 is an explanatory external perspective view of an example of a liquid discharge head.
Figure 4:
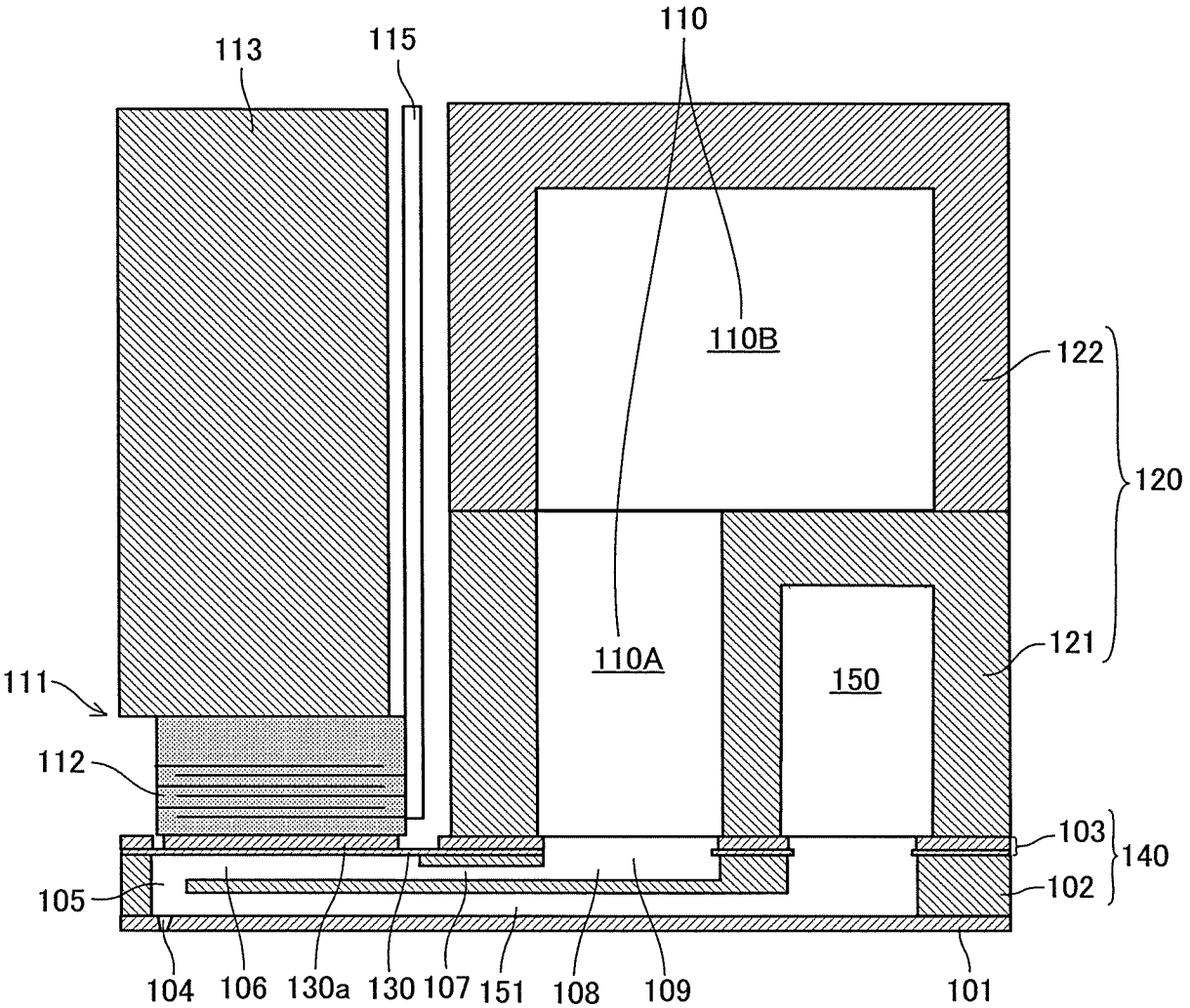
FIG. 4 is an explanatory cross-sectional view extending in a direction (longitudinal direction of a liquid chamber) perpendicular to the nozzle array direction of the head.

Next, an example of the liquid discharge head will be described referring to FIGS. 3 and 4. FIG. 3 is an explanatory external perspective view of the liquid discharge head, and FIG. 4 is an explanatory cross-sectional view extending perpendicular to the nozzle array direction of the head (longitudinal direction of the liquid chamber). The nozzle array direction is indicated by arrow "NAD" in FIGS. 2, 3, and 7. The nozzle array direction NAD is perpendicular to the medium conveyance direction MCD.

In this liquid discharge head 100, a nozzle plate 101, a channel plate 102, and a vibration plate member 103 as a wall member are stacked and joined. Further, the liquid discharge head includes a piezoelectric actuator 111 to displace a vibration region 130 (vibration plate) of the vibration plate member 103, a common chamber member 120 also serving as a frame member of the head, and a cover 129. A portion made of the channel plate 102 and the vibration plate member 103 is referred to as a channel member 140.

The nozzle plate 101 has a plurality of nozzles 104 to discharge a liquid.

The channel plate 102 forms through-holes and grooves shaping an individual chamber 106 communicating with the nozzle 104 via a nozzle communication path 105, a supply-side fluid restrictor 107 communicating with the individual chamber 106, and a liquid introduction portion 108 communicating with the supply-side fluid restrictor 107. The nozzle communication path 105 is a channel extending to communicate with the nozzle 104 and the individual chamber 106, respectively. Further, the liquid introduction portion 108 communicates with a supply-side common chamber 110 via an opening 109 of the vibration plate member 103.

The vibration plate member 103 has the deformable vibration region 130 that forms the wall surface of the individual chamber 106 of the channel plate 102. Here, the vibration plate member 103 has a two-layer structure (not limited) and is formed of a first layer forming a thin portion and a second layer forming a thick portion in order from the channel plate 102 side, and the deformable vibration region 130 is formed in a portion of the first layer corresponding to the individual chamber 106.

A piezoelectric actuator 111 including an electromechanical transducer as a drive unit (actuator unit, pressure generation unit) to deform the vibration region 130 of the vibration plate member 103 is disposed on the side opposite to the individual chamber 106 of the vibration plate member 103.

In this piezoelectric actuator 111, a piezoelectric member joined on a base member 113 is subjected to half-cut-dicing for groove processing to form a required number of columnar piezoelectric elements 112 at predetermined intervals in a comb shape.

The piezoelectric element 112 is joined to a protrusion 130*a* which is an island-shaped thick portion in the vibration region 130 of the vibration plate member 103. A flexible wiring member 115 is coupled to the piezoelectric element 112.

The common chamber member 120 forms the supply-side common chamber 110 and a recovery-side common chamber 150. The supply-side common chamber 110 communicates with a supply port 171, and the recovery-side common chamber 150 communicates with a recovery port 172.

In this case, the common chamber member 120 is made of a first common chamber member 121 and a second common chamber member 122, and the first common chamber member 121 is joined on the channel member 140 on the vibration plate member 103 side and the second common chamber member 122 is stacked and joined to the first common chamber member 121.

The first common chamber member 121 forms a downstream-side common chamber 110A which is a part of the supply-side common chamber 110 communicating with the liquid introduction portion 108 and the recovery-side common chamber 150 which communicates with a recovery channel 151. In addition, the second common chamber member 122 forms an upstream-side common chamber 110B which is the remaining part of the supply-side common chamber 110.

The channel plate 102 forms the recovery channel 151 along the surface direction of the channel plate 102 communicating with each individual chamber 106 via the nozzle communication path 105. The recovery channel 151 communicates with the recovery-side common chamber 150.

The head 100 includes a supply-side common chamber 110 communicating with the supply port 171, a recovery-side common chamber 150 communicating with the recovery port 172, a plurality of individual chambers 106 communicating with the supply-side common chamber 110 and the nozzles 104, and a plurality of recovery channels 151 communicating with the recovery-side common chamber 150 and the nozzles 104.

In the liquid discharge head 100, for example, the voltage applied to the piezoelectric element 112 is lowered from the reference potential (intermediate potential) to contract the piezoelectric element 112 so that the vibration region 130 of the vibration plate member 103 is pulled and the volume of the individual chamber 106 is increased, whereby the liquid flows into the individual chamber 106.

Thereafter, the voltage applied to the piezoelectric element 112 is increased to elongate the piezoelectric element 112 in the stacking direction, and the vibration region 130 of the vibration plate member 103 is deformed in a direction toward the nozzle 104 to reduce the volume of the individual chamber 106, whereby the liquid in the individual chamber 106 is pressurized and is discharged from the nozzle 104.

The liquid not discharged from the nozzle 104 goes around the nozzle 104 and flows from the recovery channel 151 into the recovery-side common chamber 150 and is supplied from the recovery-side common chamber 150 to the supply-side common chamber 110 again through the external circulation channel.

Note that the method of driving the head is not limited to the above example (pull-push discharge), pull discharge or push discharge can be performed depending on the given driving waveform.

Figure 5:
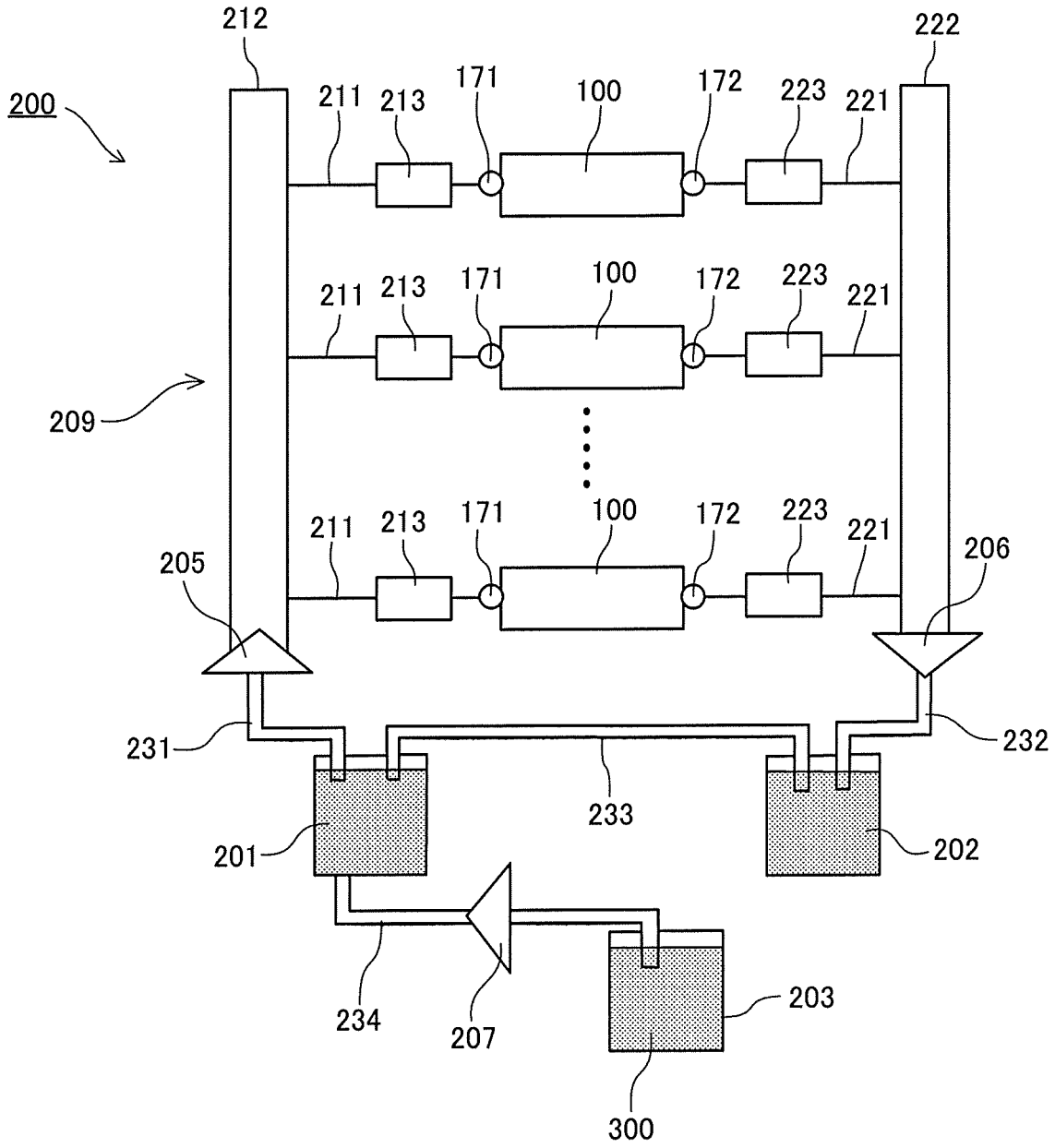
FIG. 5 is an explanatory block diagram of a part related to a liquid circulation device.

Next, a part related to the liquid circulation device will be described referring to FIG. 5. FIG. 5 is an explanatory block diagram for illustrating the liquid circulation device.

A liquid circulation device 200 has a supply tank 201 as a first sub tank, a recovery tank 202 as a second sub tank, and a replenishment tank 203 as a main tank of a liquid storage unit to store a liquid 300 discharged from the head 100.

In addition, the liquid circulation device 200 includes a supply pump 205 as a first liquid feed pump, a recovery pump 206 as a second liquid feed pump, and a replenishment pump 207 as a third liquid feed pump.

In addition, the liquid circulation device 200 is provided with a common supply channel 212 which is a first manifold communicating with the supply ports 171 of the plurality of heads 100 via respective individual supply channels 211. Further, the liquid circulation device 200 includes a common recovery channel 222, which is a second manifold communicating with the recovery ports 172 of the plurality of heads 100 via respective individual recovery channels 221.

Then, the supply pump 205 sends the liquid from the supply tank 201 to the common supply channel 212 via a liquid path 231. The recovery pump 206 sends the liquid from the common recovery channel 222 to the recovery tank 202 via a liquid path 232.

Here, the supply tank 201 and the recovery tank 202 communicate with each other through a liquid path 233. Further, the supply tank 201 and the replenishment tank 203 communicate with each other through a liquid path 234.

As a result, a circulation channel 209 is formed in which a liquid is circulated from supply tank 201 through the liquid path 231, the common supply channel 212, the individual supply channel 211, the above-described respective channels inside the head 100 (the supply-side common chamber 110, the individual chamber 106, the recovery channel 151, recovery-side common chamber 150, etc.), the individual recovery channel 221, the common recovery channel 222, the liquid path 232, the recovery tank 202, and the liquid path 233.

In the present embodiment, the individual supply channel 211 is provided with a supply-side fluid resistance variable section 213 capable of changing the fluid resistance, and the individual recovery channel 221 is provided with the recovery-side fluid resistance variable section 223 capable of changing the fluid resistance.

Figure 6:
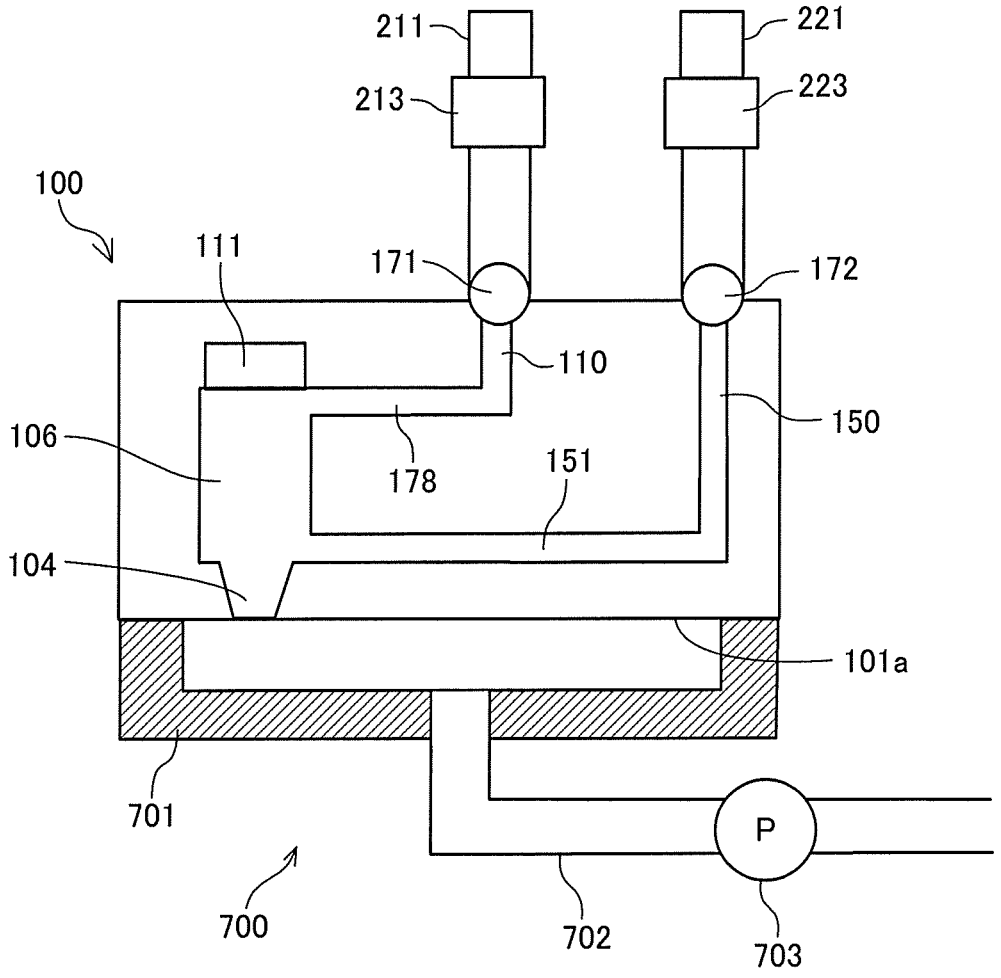
FIG. 6 is an explanatory schematic view of a head and a suction maintenance mechanism according to a first embodiment of the present disclosure.
Figure 7:
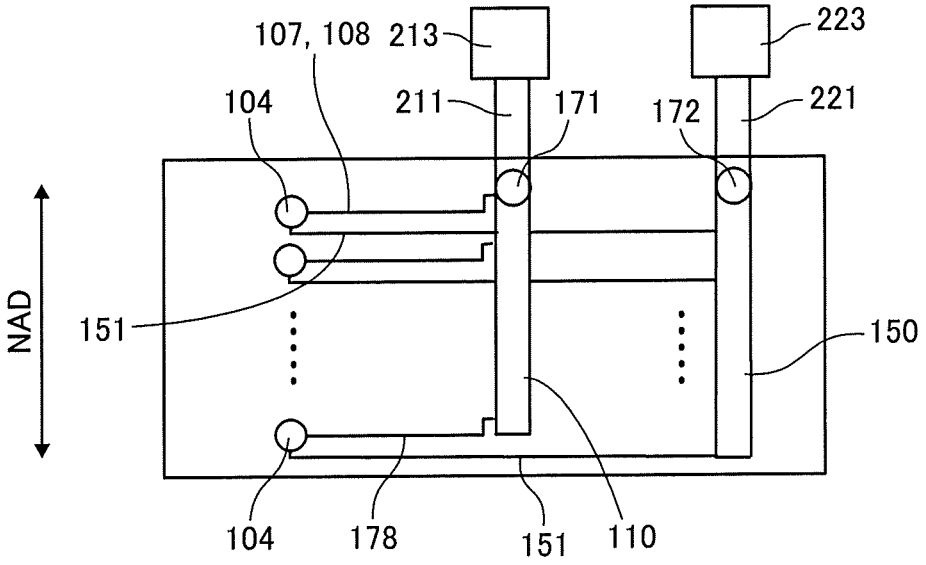
FIG. 7 is an explanatory plan view of the head.

Next, the head and suction maintenance mechanism in the first embodiment of the present disclosure will be described referring to FIGS. 6 and 7. FIG. 6 is an explanatory schematic view of the head and the suction maintenance mechanism, and FIG. 7 is an explanatory plan view of the head.

The head 100 in the present embodiment is different from the head 100 described referring to FIG. 4 described above in that the recovery channel 151 is coupled to the individual chamber 106 and does not have the nozzle communication path 105, but the same reference numerals are given to the corresponding portions, and the description thereof will be omitted as other parts have similar structures. In this case, the liquid introduction portion 108 and the supply-side fluid restrictor 107 are referred to as a supply channel 178.

In addition, since the configuration of the liquid circulation device 200 for the head 100 is the same as that described above referring to FIG. 5, here, the portion from the common supply channel 212 to the common recovery channel 222 is illustrated.

A maintenance mechanism 700 includes a cap 701 to cap a nozzle surface 101*a* of the head 100. The cap 701 is disposed so as to be capable of advancing and retreating with respect to the nozzle surface 101*a* and is advanced and retreated by a cap moving mechanism 571 to be described later.

A suction path 702 is coupled to the cap 701, and a suction pump 703 which is a suction unit is provided in the suction path 702. The nozzle surface 101*a* of the head 100 is capped with the cap 701 and the suction pump 703 is driven to suck the liquid from the nozzle 104 into the cap 701 to eject the liquid.

The maintenance drive control unit 500 controls the maintenance operation of moving the cap 701 through a cap moving mechanism 571 to cap the nozzle surface 101*a* and driving the suction pump 703 so as to suck the liquid from the nozzle 104 to eject the liquid.

Figure 8A:
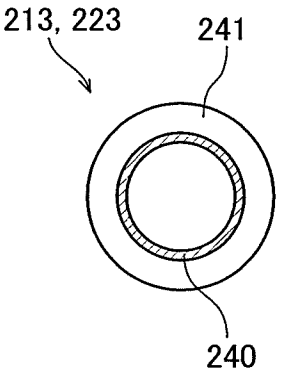
FIGS. 8A to 8C are explanatory cross-sectional views of a fluid resistance variable section in the first embodiment of the present disclosure.
Figure 8B:
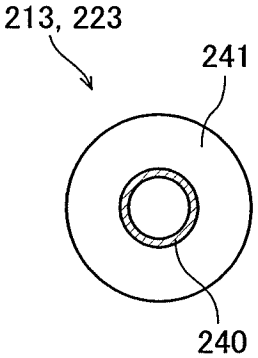
Figure 8C:
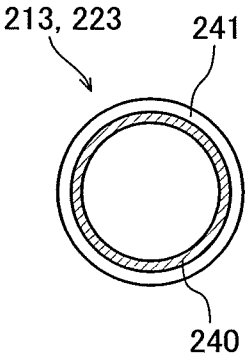

Next, the fluid resistance variable section in the first embodiment will be described referring to FIGS. 8A to 8C. FIGS. 8A to 8C are explanatory cross-sectional views of the fluid resistance variable section.

Each of the supply-side fluid resistance variable section 213 and the recovery-side fluid resistance variable section 223 includes a liquid path 240 that is restorably deformable and a vacuum chamber 241 that covers the periphery of the liquid path 240.

Then, as illustrated in FIG. 8B, the vacuum chamber 241 is pressurized (lowering the degree of vacuum) from the state illustrated in FIG. 8A so that the liquid path 240 is crushed and the fluid resistance increases.

On the other hand, as illustrated in FIG. 8C, the vacuum chamber 241 is depressurized (increasing the degree of vacuum) from the state illustrated in FIG. 8A so that the liquid path 240 expands and the fluid resistance reduces.

Thus, each of the supply-side fluid resistance variable section 213 and the recovery-side fluid resistance variable section 223 includes a liquid path 240 and a vacuum chamber 241 covering the liquid path. The circuitry pressurizes or depressurizes the vacuum chamber 241 of the supply-side fluid resistance variable section 213 and the vacuum chamber 241 of the recovery-side fluid resistance variable section 223 to vary the fluid resistance of the individual supply channel 211 and the fluid resistance of the individual recovery channel 221, respectively.

In this way, the negative pressure of the vacuum chambers 241 is changed to vary the cross-sectional area of the opening in the liquid path 240 so that the fluid resistance of the supply-side fluid resistance variable section 213 and the recovery-side fluid resistance variable section 223 changes, and then the fluid resistance of the individual supply channel 211 and the individual recovery channel 221 changes.

Figure 9:
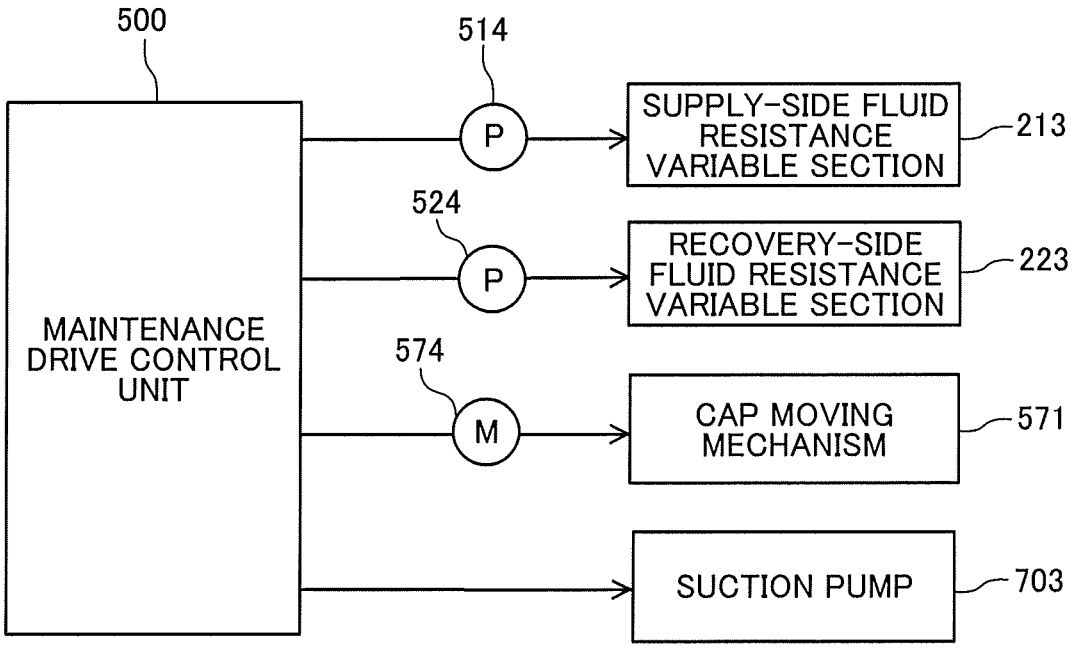
FIG. 9 is an explanatory block diagram of a part relating to a maintenance operation in the first embodiment of the present disclosure.

Next, the control of the part related to the maintenance operation in the first embodiment will be described referring to the explanatory block diagram of FIG. 9.

A maintenance drive control unit 500 controls the driving of a vacuum pump 514 to control the negative pressure in the vacuum chamber 241 of the supply-side fluid resistance variable section 213 to change the fluid resistance of the individual supply channel 211. The maintenance drive control unit 500 controls the driving of a vacuum pump 524 to control the negative pressure in the vacuum chamber 241 of the recovery-side fluid resistance variable section 223 to change the fluid resistance of the individual recovery channel 221.

The maintenance drive control unit 500 controls the driving of a drive motor 574 to drive the cap moving mechanism 571 to advance and retreat the cap 701. Further, the maintenance drive control unit 500 controls the driving of the suction pump 703.

Functions executed by the maintenance drive control unit 500 may be implemented by one or more processing circuits or circuitry. Processing circuitry includes a programmed processor, as a processor includes circuitry. A processing circuit also includes devices such as the central processing unit (CPU), an application specific integrated circuit (ASIC), digital signal processor (DSP), field programmable gate array (FPGA), and conventional circuit components arranged to perform the recited functions.

Figure 10:
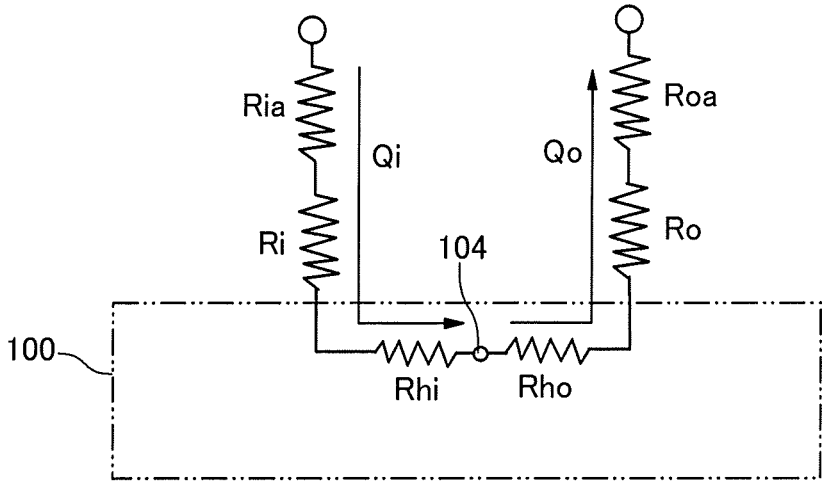
FIG. 10 is an explanatory equivalent diagram of fluid resistance from the supply-side individual path to the recovery-side individual path.

Next, the flow rate and the fluid resistance of each section when the maintenance operation is performed will be described referring to FIG. 10. FIG. 10 is an explanatory equivalent diagram of the fluid resistance from the supply-side individual path to the recovery-side individual path.

It is assumed that the fluid resistance of the individual supply channel 211 is Ri, the fluid resistance of the supply-side fluid resistance variable section 213 is Ria, the fluid resistance of the individual recovery channel 221 is Ro, the fluid resistance of the recovery-side fluid resistance variable section 223 is Roa, the total value of the fluid resistance from the supply port 171 to the nozzle 104 in the head 100 is Rhi, and the total value of the fluid resistance from the nozzle 104 to the recovery port 172 in the head 100 is Rho.

Here, when a liquid is sucked from the nozzle 104 by the maintenance mechanism 700, the suction flow rate Qd is the sum of the supply-side suction flow rate Qi and the recovery-side suction flow rate Qo (Qd=Qi+Qo).

Then, the supply-side suction flow rate Qi and the recovery-side suction flow rate Qo are obtained by the following equations 1 and 2, respectively.

$$Qi=Qd\times(Rho+Ro+Roa)/(Ria+Ri+Rhi+Ro+Roa+Rho) \quad \text{[Equation 1]}$$

$$Qo=Qd\times(Ria+Ri+Rhi)/(Ria+Ri+Rhi+Ro+Roa+Rho) \quad \text{[Equation 2]}$$

Next, control of the maintenance operation by the maintenance drive control unit will be described referring to FIGS. 11 and 12.

Figure 11:
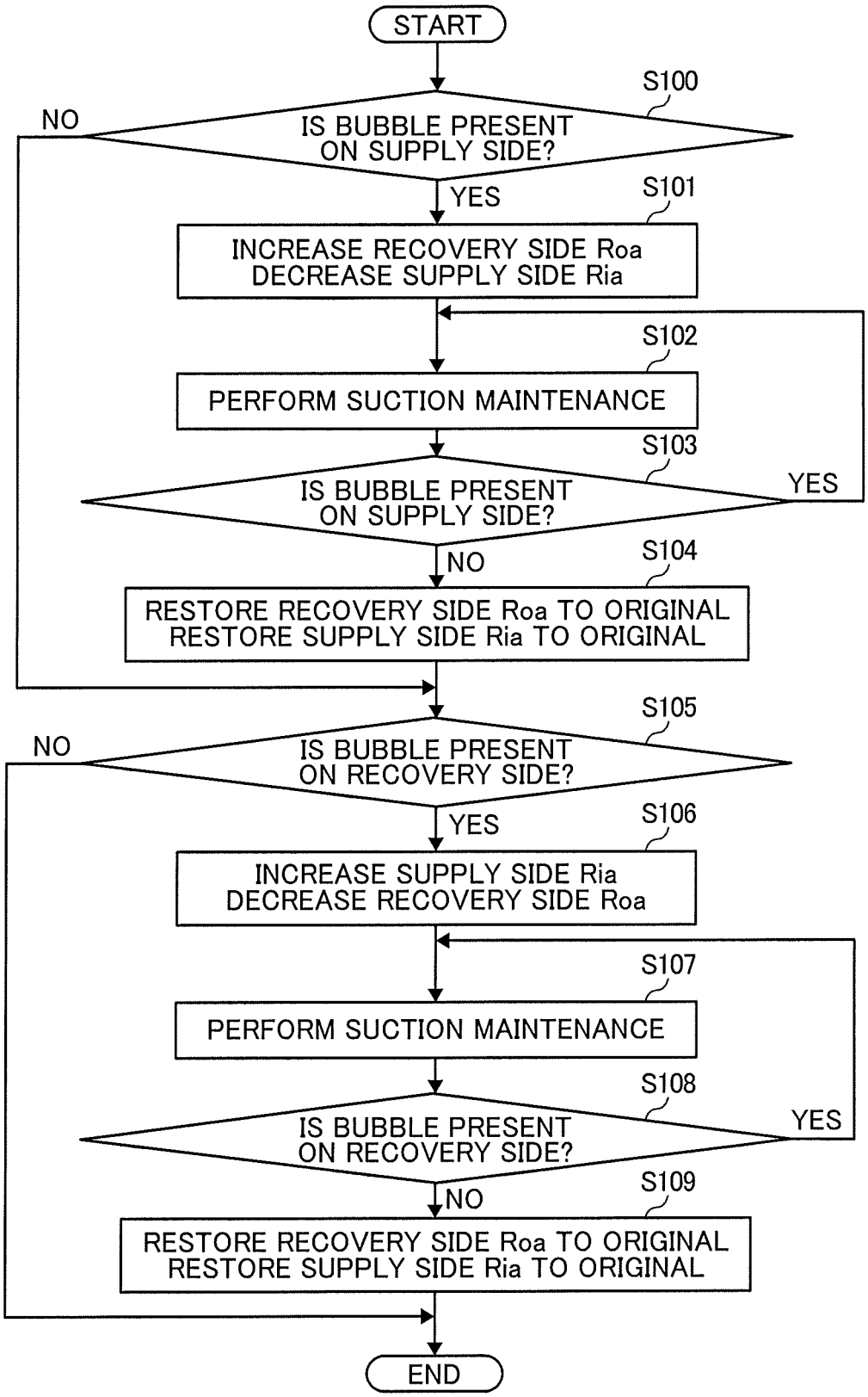
FIG. 11 is a flowchart for illustrating control of the maintenance operation by a maintenance drive control unit.
Figure 12:
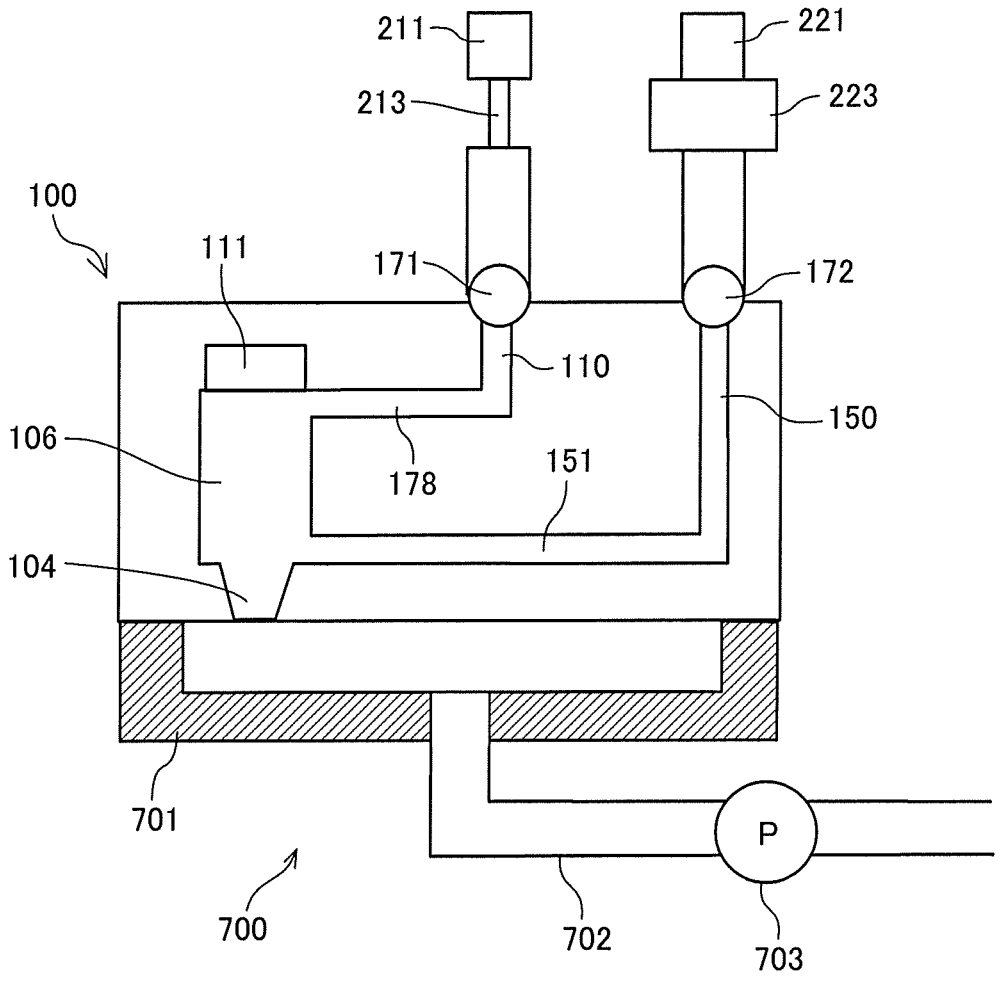
FIG. 12 is an explanatory diagram for mainly illustrating a state when a liquid is sucked from the recovery side in the maintenance operation.

FIG. 11 is a flowchart for illustrating the control of the maintenance operation, and FIG. 12 is an explanatory view mainly for illustration when a liquid is sucked from the recovery side.

First, whether bubbles are present on the supply side is determined (S100).

Here, when bubbles are present on the supply side (S100, YES), the fluid resistance Roa of the recovery-side fluid resistance variable section 223 is set higher than the fluid resistance when the liquid is circulated. Further, the fluid resistance Ria of the supply-side fluid resistance variable section 213 is set lower than the fluid resistance when the liquid is circulated (S101).

This enables the liquid to flow more easily in the individual supply channel 211 than when the liquid is circulated, and enables the liquid to flow less easily in the individual recovery channel 221 than when the liquid is circulated.

Then, the suction pump 703 is driven with the nozzle surface 101*a* capped with the cap 701 to perform a suction maintenance operation of sucking the liquid from the nozzle 104 and discharging the liquid into the cap 701 (S102).

At this time, since the liquid flows easily in the individual supply channel 211 and the liquid flows with difficulty in the individual recovery channel 221, more liquid is sucked through the individual supply channel 211 side than the individual recovery channel 221 side to be discharged from the nozzle 104.

Thereafter, whether air bubbles are present on the supply side is determined again (S103), and when there is no bubble on the supply side (S103, NO), the fluid resistance Roa of the recovery-side fluid resistance variable section 223 and the fluid resistance Ria of the supply-side fluid resistance variable section 213 are returned to the fluid resistance value when the liquid is circulated, respectively (returned to the original) (S104).

That is, the circuitry (the maintenance drive control unit 500) causes the supply-side fluid resistance variable section 213 and the recovery-side fluid resistance variable section 223 to set each of the fluid resistance of the individual supply channel 211 and the fluid resistance of the individual recovery channel 221 to a fluid resistance of the liquid circulating through the circulation channel 209 after the maintenance operation.

Next, whether bubbles are present on the recovery side is determined (S105), and when bubbles are present on the recovery side (S105, YES), the fluid resistance Ria of the supply-side fluid resistance variable section 213 is set higher than the fluid resistance when the liquid is circulated. Further, the fluid resistance Roa of the recovery-side fluid resistance variable section 223 is lower than the fluid resistance when the liquid is circulated (S106).

This enables the liquid to flow more easily in the individual recovery channel 221 than when the liquid is circulated, and enables the liquid to flow less easily in the individual supply channel 211 than when the liquid is circulated.

Then, the suction pump 703 is driven with the nozzle surface 101*a* capped with the cap 701 to perform a suction maintenance operation of sucking the liquid from the nozzle 104 and discharging the liquid into the cap 701 (S107).

At this time, since the liquid easily flows in the individual recovery channel 221 and the liquid flows with difficulty in the individual supply channel 211, more liquid is sucked through the individual recovery channel 221 side than through the individual supply channel 211 side to be discharged from the nozzle 104.

Thereafter, whether bubbles are present on the recovery side is determined again (S108), and when there is no bubble on the recovery side (S108, NO), the fluid resistance Ria of the supply-side fluid resistance variable section 213 and the fluid resistance Roa of the recovery-side fluid resistance variable section 223 are returned to the fluid resistance value when the liquid is circulated, respectively (returned to the original) (S109).

That is, the fluid resistance of the supply-side fluid resistance variable section 213 and the fluid resistance of the recovery-side fluid resistance variable section 223 is set to a fluid resistance of the liquid circulating through the circulation channel 209 after the maintenance operation.

That is, when bubbles are present on the supply side, the fluid resistance Roa of the recovery-side fluid resistance variable section 223 is increased and the fluid resistance Ria of the supply-side fluid resistance variable section 213 is reduced so that the liquid can be sucked keeping the relationship of Qi>Qo with respect to the suction flow rate Qd. As a result, the liquid on the supply side can be sucked to discharge bubbles in a concentrated manner.

On the other hand, when bubbles exist on the recovery side, the liquid path 240 of the supply-side fluid resistance variable section 213 is narrowed to increase the fluid resistance Ria and the liquid path 240 of the recovery-side fluid resistance variable section 223 is expanded to reduce the fluid resistance Roa, as illustrated in FIG. 12. As a result, the liquid can be sucked keeping the relationship Qo>Qi with respect to the suction flow rate Qd, and the liquid on the recovery side can be sucked to discharge bubbles in a concentrated manner.

As a result, maintenance can be efficiently performed, and the amount of the liquid consumed wastefully can be suppressed.

Thus, the printing apparatus 1000 includes circuitry (the maintenance drive control unit 500) to cause the supply-side fluid resistance variable section 213 and the recovery-side fluid resistance variable section 223 to change the fluid resistance of the individual supply channel 211 and the fluid resistance of the individual recovery channel 221. The circuitry (the maintenance drive control unit 500) causes the supply-side fluid resistance variable section 213 and the recovery-side fluid resistance variable section 223 to increase one of the fluid resistance of the individual supply channel 211 and the fluid resistance of the individual recovery channel 221 to be higher than another of the fluid resistance of the individual supply channel 211 and the fluid resistance of the individual recovery channel 221 in the maintenance operation.

For example, the circuitry (the maintenance drive control unit 500) may cause the supply-side fluid resistance variable section 213 and the recovery-side fluid resistance variable section 223 to increase the fluid resistance of the individual supply channel 211 to be higher than the fluid resistance of the individual recovery channel 221 in the maintenance operation.

Further, the circuitry (the maintenance drive control unit 500) may cause the supply-side fluid resistance variable section 213 and the recovery-side fluid resistance variable section 223 to increase the fluid resistance of the individual recovery channel 221 to be higher than the fluid resistance of the individual supply channel 211 in the maintenance operation.

Figure 13:
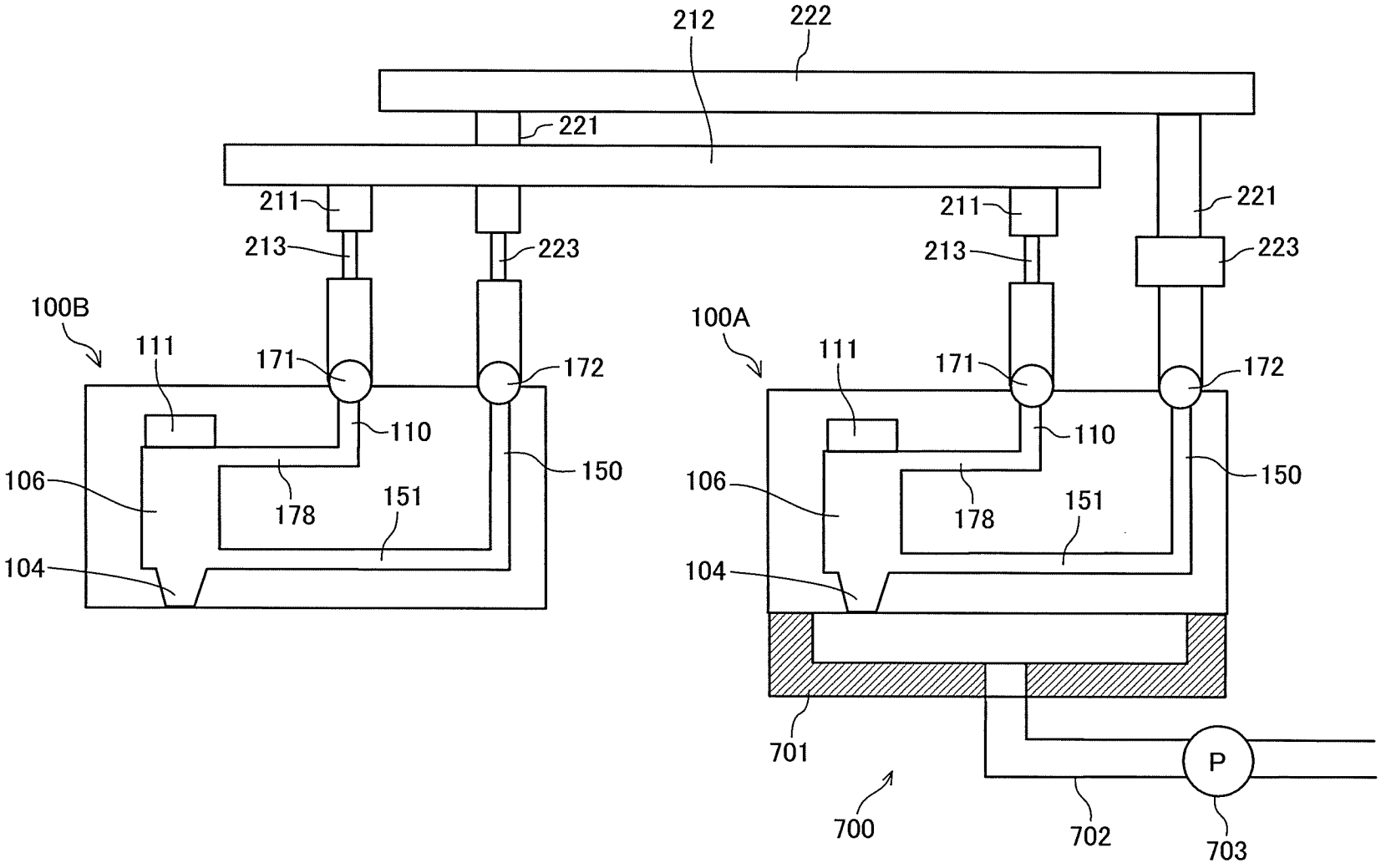
FIG. 13 is an explanatory schematic view around a head and a suction maintenance mechanism for illustrating a maintenance operation in a second embodiment of the present disclosure.

Next, a second embodiment of the present disclosure will be described referring to FIG. 13. FIG. 13 is an explanatory schematic view around the head and the suction maintenance mechanism for illustrating the maintenance operation in the second embodiment.

In the present embodiment, when a maintenance operation is performed on a specific head 100A, the fluid resistance Ria of the supply-side fluid resistance variable section 213 and the fluid resistance Roa of the recovery-side fluid resistance variable section 223 for the head other than the specific head 100A (represented by a head 100B in this case) are both made high compared with (relative to) the fluid resistance Ria of the supply-side fluid resistance variable section 213 and the fluid resistance Roa of the recovery-side fluid resistance variable section 223 of the head 100A subjected to the maintenance operation.

Thereby, when the maintenance operation is performed with respect to the specific head 100A of a plurality of heads 100 connected by the common supply channel 212 and the common recovery channel 222, the suction of the liquid from the head 100B other than the head 100A via the common supply channel 212 and the common recovery channel 222 can be suppressed.

As a result, the targeted head can be efficiently maintained.

Figure 14A:
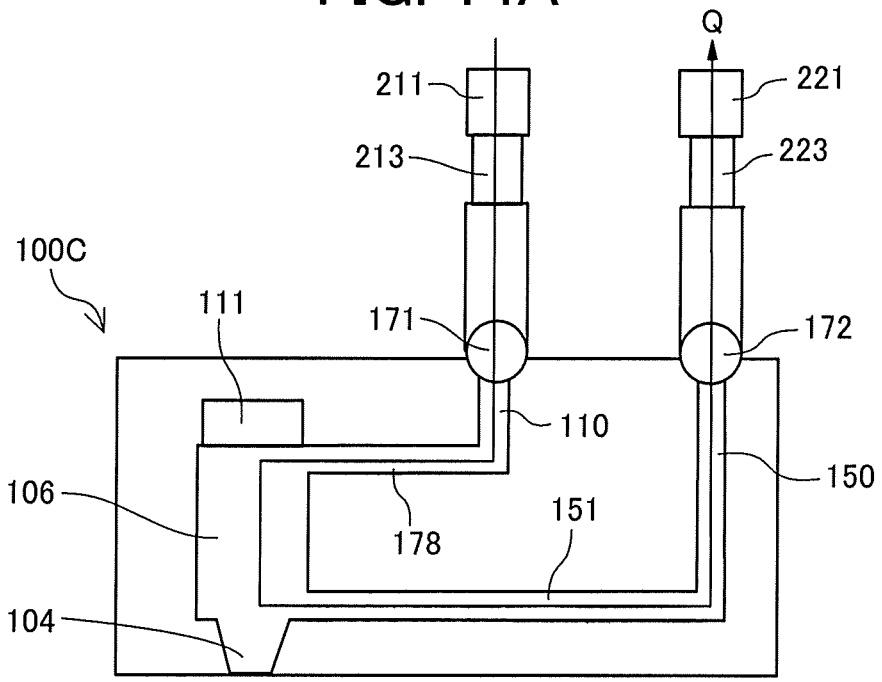
FIGS. 14A and 14B are explanatory schematic views around a head and a suction maintenance mechanism for illustrating a maintenance operation in a third embodiment of the present disclosure.
Figure 14B:
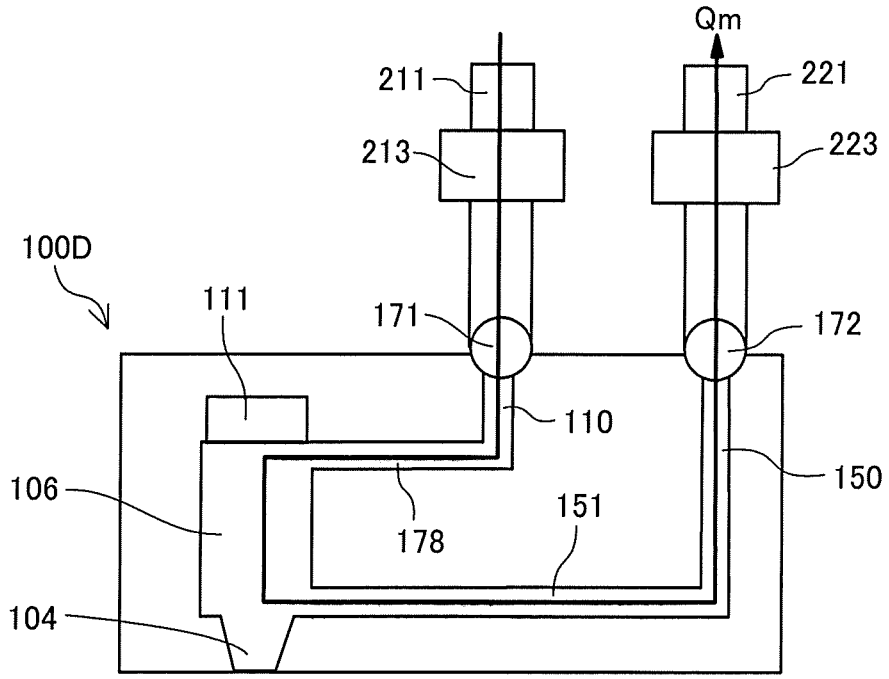

Next, a third embodiment of the present disclosure will be described referring to FIGS. 14A and 14B. FIGS. 14A and 14B are explanatory schematic views around the head and the suction maintenance mechanism for illustrating the maintenance operation in the third embodiment.

In the present embodiment, as illustrated in FIG. 14A, with respect to a head 100C that is discharging a liquid in the printing operation, the liquid is circulated at a circulation rate Q with the fluid resistance Ria of the supply-side fluid resistance variable section 213 and the fluid resistance Roa of the recovery-side fluid resistance variable section 223 both equal to the fluid resistance when the liquid is circulated.

On the other hand, as illustrated in FIG. 14B, with respect to a head 100D that does not discharge the liquid in the printing operation or does not discharge the liquid for a predetermined time or more, the liquid is circulated at the circulation rate Qm (Qm>Q) with the fluid resistance Ria of the supply-side fluid resistance variable section 213 and the fluid resistance Roa of the recovery-side fluid resistance variable section 223 both low compared with (relative to) the fluid resistance Ria of the supply-side fluid resistance variable section 213 and the fluid resistance Roa of the recovery-side fluid resistance variable section 223 of any other head 100C that is discharging a liquid.

As a result, with respect to the head 100D that does not discharge the liquid in the printing operation or does not discharge the liquid for a predetermined time or more, the circulation rate increases, so that a fresher liquid can be supplied to the vicinity of the nozzle 104, the progress of thickening can be suppressed in the nozzle 104.

Thus, the circuitry (the maintenance drive control unit 500) performs the maintenance operation on one of the plurality of liquid discharge heads 100 that has not discharged the liquid from the nozzles 104 for a predetermined time.

Thus, the printing apparatus 1000 includes circuitry (the maintenance drive control unit 500) to cause the plurality of supply-side fluid resistance variable sections 213 and the plurality of recovery-side fluid resistance variable sections 223 to change the fluid resistances of the plurality of individual supply channels 211 and the fluid resistances of the plurality of individual recovery channels 221.

Specifically, the circuitry (the maintenance drive control unit 500) causes the plurality of supply-side fluid resistance variable sections 213 and the plurality of recovery-side fluid resistance variable sections 223 to decrease a fluid resistance of each of one of the plurality of individual supply channels 211 and one of the plurality of individual recovery channels 221, which are connected to one of the plurality of liquid discharge heads 100 on which the maintenance operation is performed, to be lower than a fluid distance of each of another of the plurality of individual supply channels 211 and another of the plurality of individual recovery channels 221, which are connected to another of the plurality of liquid discharge heads 100 on which the maintenance operation is not performed, in the maintenance operation.

In the present application, the discharged "liquid" is not particularly limited as long as the liquid has a viscosity and a surface tension enough to allow the liquid to be discharged from the head, but the liquid has preferably a viscosity of 30 mPa·s or less at ordinary temperature and ordinary pressure or by heating or cooling. To be more specific, the liquid is a solution, a suspension, an emulsion or the like containing a solvent such as water or an organic solvent, a colorant such as a dye or a pigment, a functionalizing material such as a polymerizable compound, resin or surfactant, a biocompatible material such as DNA, amino acid, protein, calcium, etc., an edible material such as a natural pigment, and the like, and these materials can be used, for example, for inkjet inks, surface treatment liquids, liquids for forming constituent elements of electronic elements and light emitting elements or electronic circuit resist patterns, material liquids for three-dimensional molding, and the like.

The term "liquid discharge head" includes a head using, as an energy generating source for discharging a liquid, a piezoelectric actuator (laminated piezoelectric element and thin film piezoelectric element), a thermal actuator using an electrothermal transducer such as a heating resistor, and an electrostatic actuator made of vibration plate and counter electrode.

The term "a liquid discharge apparatus" includes an apparatus that discharges a liquid by driving a liquid discharge head. An apparatus that discharges a liquid includes not only an apparatus capable of discharging a liquid to a liquid-adherable material but also an apparatus that discharges a liquid toward air or a liquid.

The term "a liquid discharge apparatus" can include a device related to feeding, conveying, sheet ejection of substance to which a liquid can adhere, and in addition, include a preprocessing device, a post-processing apparatus, and the like.

For example, as an "a liquid discharge apparatus", there are an image forming apparatus which is an apparatus for discharging ink to form an image on a sheet and a 3D molding apparatus (three-dimensional molding apparatus) for discharging a molding liquid onto a powder layer formed by layering powder in order to mold a solid object (three-dimensional model).

Further, the term "a liquid discharge apparatus" is not limited to one which visualizes significant images such as letters, graphics, etc. by the discharged liquid. For example, one that forms a pattern or the like that has no meaning itself, and one that molds a three-dimensional model are included.

The above term "liquid-adherable material" means a material to which a liquid can be attached at least temporarily such as a material subjected to fixing by adherence, permeation by adherence, or the like. Specific examples include a recording medium such as a paper sheet, recording paper, a recording sheet, a film, and cloth, an electronic component such as an electronic substrate and a piezoelectric element, and a medium such as a powder layer, an organ model, and an inspection cell, and also include everything to which a liquid adheres unless specifically limited.

The above-mentioned "liquid-adherable material" may be any material as long as a liquid can at least temporarily adhere to the material such as paper, thread, fiber, cloth, leather, metal, plastic, glass, wood, and ceramics.

In addition, there is an apparatus in which a liquid discharge head and a liquid-adherable material move relative to each other as an "a liquid discharge apparatus", but the apparatus is not limited to this. Specific examples include a serial type apparatus that moves the liquid discharge head, a line type apparatus that does not move the liquid discharge head, and the like.

Further, an "a liquid discharge apparatus" also includes a treatment liquid application apparatus for discharging a treatment liquid onto a sheet in order to apply the treatment liquid to the surface of the paper for the purpose of modifying the surface of the paper, an injection granulator for granulating an object with fine particles of a raw material by spraying through a nozzle a composition liquid in which a raw material is dispersed in a solution, and the like.

In the terms in the present application, image forming, recording, printing, molding and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head including a supply port, a recovery port, and nozzles to discharge a liquid from the nozzles;

a circulation channel connected to the supply port and the recovery port of the liquid discharge head to circulate the liquid through the liquid discharge head; and a cap to cap a nozzle surface of the liquid discharge head in which the nozzles are formed and to suck the liquid from the nozzles in a maintenance operation, the circulation channel including:

an individual supply channel communicating with the supply port of the liquid discharge head;

an individual recovery channel communicating with the recovery port of the liquid discharge head to circulate the liquid through the liquid discharge head;

a supply-side fluid resistance variable section disposed in the individual supply channel to vary a fluid resistance of the individual supply channel;

a recovery-side fluid resistance variable section disposed in the individual recovery channel to vary a fluid resistance of the individual recovery channel; and a circuitry causes the supply-side fluid resistance variable section and the recovery-side fluid resistance variable section to change the fluid resistance of the individual supply channel and the fluid resistance of the individual recovery channel, wherein the circuitry causes the supply-side fluid resistance variable section and the recovery-side fluid resistance variable section to increase one of the fluid resistance of the individual supply channel and the fluid resistance of the individual recovery channel to be higher than another of the fluid resistance of the individual supply channel and the fluid resistance of the individual recovery channel in the maintenance operation.

2. The liquid discharge apparatus according to claim 1, wherein the circuitry causes the supply-side fluid resistance variable section and the recovery-side fluid resistance variable section to increase the fluid resistance of the individual supply channel to be higher than the fluid resistance of the individual recovery channel in the maintenance operation.

3. The liquid discharge apparatus according to claim 1, wherein the circuitry causes the supply-side fluid resistance variable section and the recovery-side fluid resistance variable section to increase the fluid resistance of the individual recovery channel to be higher than the fluid resistance of the individual supply channel in the maintenance operation.

4. The liquid discharge apparatus according to claim 1, wherein the circuitry causes the supply-side fluid resistance variable section and the recovery-side fluid resistance variable section to set each of the fluid resistance of the individual supply channel and the fluid resistance of the individual recovery channel to a fluid resistance of the liquid circulating through the circulation channel after the maintenance operation.

5. The liquid discharge apparatus according to claim 1, wherein the liquid discharge head includes:

a supply-side common chamber communicating with the supply port;

a recovery-side common chamber communicating with the recovery port;

a plurality of individual chambers communicating with the supply-side common chamber and the nozzles; and a plurality of recovery channels communicating with the recovery-side common chamber and the nozzles.

6. The liquid discharge apparatus according to claim 1, wherein each of the supply-side fluid resistance variable section and the recovery-side fluid resistance variable section includes a liquid path and a vacuum chamber covering the liquid path, the circuitry pressurizes or depressurizes the vacuum chamber of the supply-side fluid resistance variable section and the vacuum chamber of the recovery-side fluid resistance variable section to vary the fluid resistance of the individual supply channel and the fluid resistance of the individual recovery channel, respectively.

7. A liquid discharge apparatus comprising:

a plurality of liquid discharge heads including supply ports, recovery ports, and nozzles, respectively, to discharge a liquid from the nozzles;

a circulation channel connected to the supply ports and the recovery ports of the plurality of liquid discharge heads to circulate the liquid through the plurality of liquid discharge heads; and a cap to cap a nozzle surface, in which the nozzles are formed, of at least one of the plurality of liquid discharge heads and to suck the liquid from the nozzles in a maintenance operation, the circulation channel including:

a plurality of individual supply channels communicating with the supply ports of the plurality of liquid discharge heads, respectively;

a plurality of individual recovery channels communicating with the recovery ports of the plurality of liquid discharge heads, respectively, to circulate the liquid through the plurality of liquid discharge heads;

a plurality of supply-side fluid resistance variable sections disposed in the plurality of individual supply channels, respectively, to vary fluid resistances of the plurality of individual supply channels;

a plurality of recovery-side fluid resistance variable sections disposed in the plurality of individual recovery channels, respectively, to vary fluid resistances of the plurality of individual recovery channels; and a circuitry causes the plurality of supply-side fluid resistance variable sections and the plurality of recovery-side fluid resistance variable sections to change the fluid resistances of the plurality of individual supply channels and the fluid resistances of the plurality of individual recovery channels, wherein the circuitry causes the plurality of supply-side fluid resistance variable sections and the plurality of recovery-side fluid resistance variable sections to decrease a fluid resistance of each of one of the plurality of individual supply channels and one of the plurality of individual recovery channels, which are connected to one of the plurality of liquid discharge heads on which the maintenance operation is performed, to be lower than a fluid distance of each of another of the plurality of individual supply channels and another of the plurality of individual recovery channels, which are connected to another of the plurality of liquid discharge heads on which the maintenance operation is not performed, in the maintenance operation.

8. A liquid discharge apparatus according to claim 7, wherein the circuitry performs the maintenance operation on one of the plurality of liquid discharge heads that has not discharged the liquid from the nozzles for a predetermined time.

* * * * *